United States Patent [19]

Yamada et al.

[11] 4,426,862

[45] Jan. 24, 1984

[54] ELECTRONIC LOCKING DEVICE

[75] Inventors: Noboru Yamada, Suita; Kenji Iio, Fukuoka; Kazuyuki Shiiba, Machida, all of Japan

[73] Assignee: Iwasaki Engineering Co., Ltd., Kyoto, Japan

[21] Appl. No.: 280,925

[22] Filed: Jul. 6, 1981

[51] Int. Cl.[3] ..... E05B 47/00; E05B 65/52

[52] U.S. Cl. ..... 70/69; 70/278

[58] Field of Search ..... 70/278, 277, 279, 67, 70/69, 70, 71, 72; 361/371, 372; 340/147 R, 147 LP, 147 MD

[56] References Cited

U.S. PATENT DOCUMENTS 4,220,022 9/1980 Willach ..... 70/278

FOREIGN PATENT DOCUMENTS 2750052 of 0000 Fed. Rep. of Germany .
2927808 of 0000 Fed. Rep. of Germany .

*Primary Examiner*—Robert L. Wolfe
*Attorney, Agent, or Firm*—Brumbaugh, Graves, Donohue & Raymond

[57] ABSTRACT

This invention relates an electronic locking device that may be operated manually and by key input, selectively, depending upon the various circumstances. In the locking condition, a hole is provided on an unlocking member and a hole is provided in a retaining mechanism, and the holes are aligned to allow the insertion of a moving piece into the both holes; and at unlocking, both of the holes are misaligned to prevent the insertion of the moving piece into either of the two holes.

2 Claims, 5 Drawing Figures

ELECTRONIC LOCKING DEVICE

BACKGROUND OF THE INVENTION

This invention relates to an electronic locking device for locking or unlocking by memory and relational computing process of the code information provided by a key input of an external memory code, and it especially relates to an electronic locking device that enables locking or unlocking by manual operation selectively depending on the intended use.

In electronic locking devices that incorporate a micro-computer or sequencer and that are locked or unlocked by key input, a number of different contrivances have so far been made to ensure highly confidential performance. Unlike the conventional mechanical locks, there is no need to carry the key at all times, there is not need to worry about robbery through the use of a duplicated skelton key by other people, and yet the confidential performance is still higher than dial type locks for safe and other devices.

With conventional electronic locking devices, the emphasis is put on their confidential performance, and, therefore, the disadvantage is that the operation is troublesome since the key input must be made even if there is some other person who is not allowed to know the locking or unlocking code, or even when there is no one near-by but if the specific person, the owner of the suit case for example, has to open and shut the suit case frequently.

SUMMARY OF THE INVENTION

In view of the foregoing, this invention is to offer a device that makes handling easier and eliminates the disadvantage in the operation of conventional electronic locking devices, i.e., to offer a device to be enable locking or unlocking freely by manual operation, by selectively blocking the electronic locking function depending on each circumstance, after turning it to unlocking condition by a key input. In other words, the device is so contrived to make manual locking or unlocking possible after placing the object in a locked or unlocked condition by operating a motor driving unit through an external key input of code.

DETAILED DESCRIPTION OF THE PREFERRED EMBODIMENT

Figure 1:
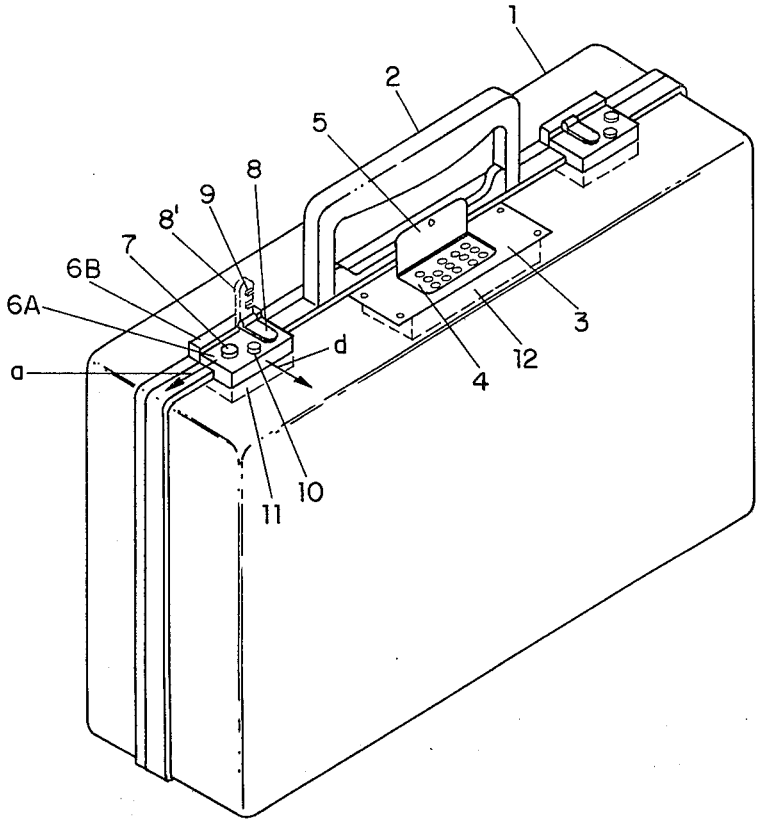
FIG. 1 is a persepctive view of a suitcase mounted with an electronic locking device according to this invention.

Referring to FIG. 1, which is the perspective view showing a suitcase provided with an electronic locking device according to this invention, a panel 3 is provided near the hanger 2 in the middle of the case 1. The key button control board 4 is placed below the panel surface 3 by several mm on which ten number keys (0–9) and four function keys are provided. The cover 5 of the control board is provided to be opened up at open-shut operation of the suit case. The clasps 6A and 6B of the case are composed of the two sections like other ordinary suitcases. The clasp 6A has an unlocking knob 7 to be pushed in the arrow direction (a) by a finger, a hook 8, which springs up as shown by the dotted line 8' because of the spring force when the internal locking mechanism is disengaged by the operation of the unlocking knob 7, and the latch 9 of the hook. The clasp 6A also has an operation knob 10, which moves in the arrow direction (d), and a control unit 11 of the electronic locking device, which is interlocked with the clasp 6A in the case 1 for controlling locking and unlocking conditions by key input. A solenoid of the motor driving unit is incorporated inside the control unit 11, and a group of dry batteries of DC 6 V, which are mounted so as to be replaced freely, is the driving power source for these units. The control unit 11 functions, in case of unlocking, when the code is supplied by correct key input through the control board 4, to disengage the locking mechanism of the control unit 11. The unlocking condition can be checked by the transmission sound of a small sized speaker placed inside the panel 3. Only when the user pushes the unlocking knob 7 in the arrow direction (a) with his finger after confirming the unlocking sound, the hook 8 springs up as shown by the dotted line 8', and the suitcase can be opened. After opening the suitcase, the normal power source is turned off to shut off unnecessary current. To close the suitcase, key input of the code is given in the same manner as above, the locked condition is confirmed by the small sized loud-speaker, and the latch 9 is inserted into the clasp 6A by hand as shown by the continuous line, thereby completing the locking operation.

Described above is the ordinary open-close operation of the suitcase by key input, in which it is done simply by pushing the locking knob 7 of the clasp 6A in the direction (a) and operation of the operation knob 10 is not required. The operation knob 10 is operated to pin or shut the suitcase only by manual operation selectively as required after unlocking by the key input as described above. The composition and function of the operation knob 10 are to be described later in detail, and now the description is given on the overall composition of the electronic locking device referring to FIG. 1 and FIG. 2. A computer control unit 12, for the operation processing of the above key input, and a mercury battery of DC 3 V, as the power source 13, are provided near each other.

Figure 2:
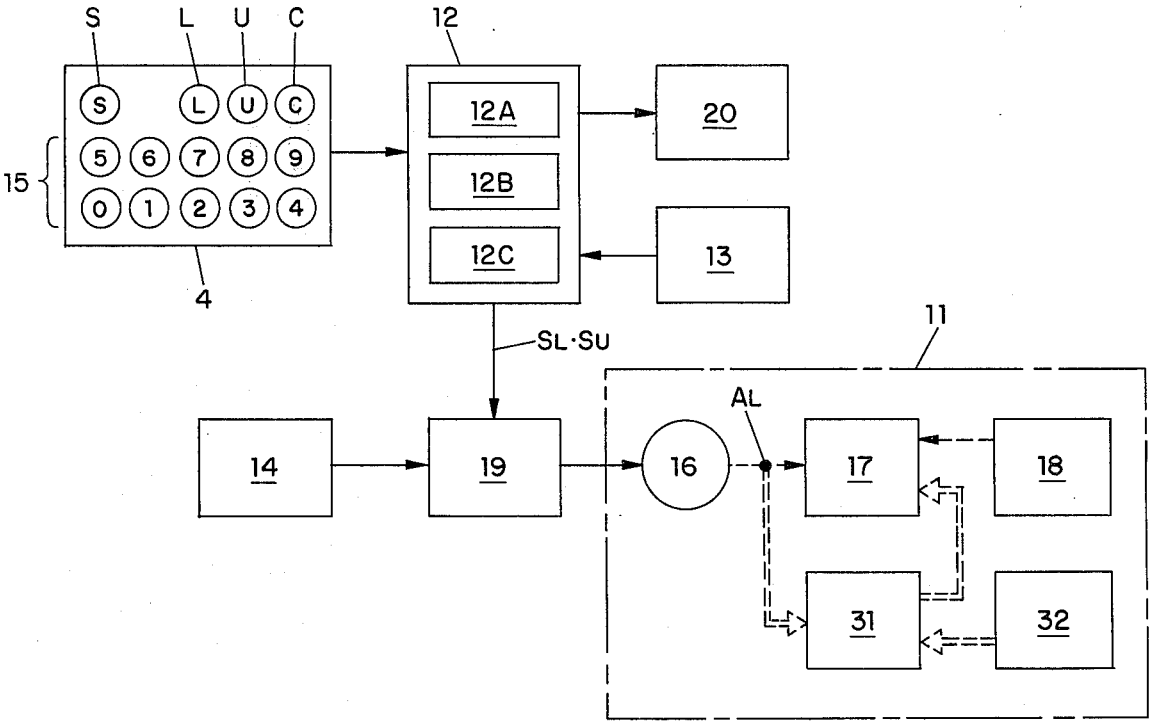
FIG. 2 is the block diagram showing the composition of an embodiment of an electronic locking device according to this invention.

FIG. 2 is a block diagram showing a circuit configuration of the electronic locking device according to this invention. Of the fourteen key buttons on the key board 4, the power switch (S) turns on the (CPU) power source 13 and the control unit power source 14, for the locking or unlocking operation. When the lock key (L) is pushed after setting the code number through the ten numeric keys 15, the solenoid 16 of the control unit 11 (within the frame of alternate long and short dashed line) functions to turn the unlocking and locking preparation mechanism 17 to a wait-for-locking condition. When the latch 9 is inserted into the clasp 6A, after confirming the transmission sound, the locking operation is completed. After locking, unnecessary current is cut off by the said power switch (S). When this key is pushed, in opening the suit case, after turning on the power switch (S) and input of the code number by the key 15 to check the transmission sound, then the solenoid 16 and the preparation mechanism 17 are operated to turn the clasp 6A into wait-for-unlocking condition. When the unlocking knob 7 is pushed by a finger in the direction (a) under this condition, the suitcases can be opened manually. The mechanism including this unlocking knob 7 is the manual controller 18. The clear key (C) erases wrong input into the ten numeric keys 15. The central processing unit 12 supplies an output of a locking signal (SL) or unlocking signal (Su) into the driving circuit 19 when the key input is correct. The relationship between the preparation mechanism for locking and unlocking 17 and the automatic retaining mechanism 31 is as follows: the driving circuit 19 receives the unlocking signal (Su) or the locking signal (SL) and makes the solenoid 16 function by the power source 14, by which the preparation mechanism 17 is placed in a possible condition for unlocking; simultaneously, the automatic retaining mechanism 31 maintains this condition of the preparation mechanism 17 by a spring incorporated in the retaining mechanism 31. Thus the preparation mechanism 17 is kept under a possible condition for locking or unlocking, which makes it possible thereafter to open the suitcase freely by only operating the manual controller, i.e., the unlocking knob 7 of FIG. 1. In case of locking, the manual controller 32, i.e., the operation knob 10 of FIG. 1 is operated manually, and then the retaining mechanism 31 is released. When, the interlocking with the preparation mechanism 17 is started with the lock action (AL) of the solenoid 16 by key input, the preparation mechanism 17 is turned to wait-for-locking mode, and locking is thereafter completed by the manual controller 18.

Figure 3:
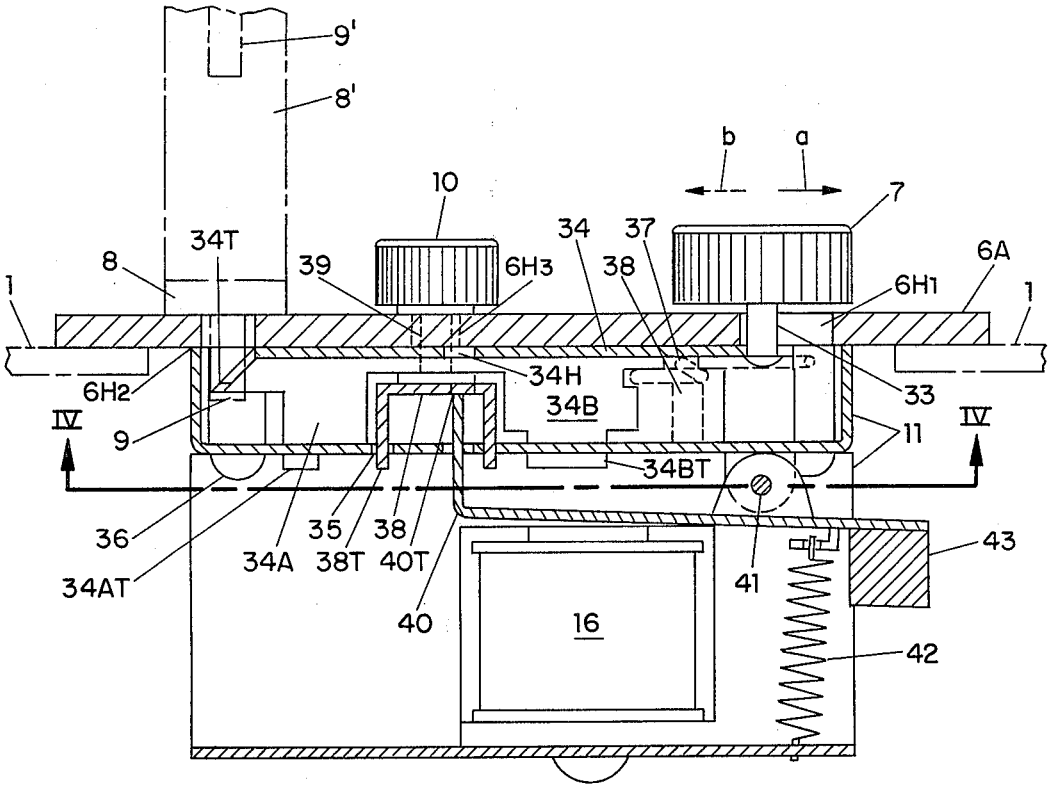
FIG. 3 is a longitudinal cross-sectional view showing the structure of the locking-unlocking control unit.
Figure 4B:
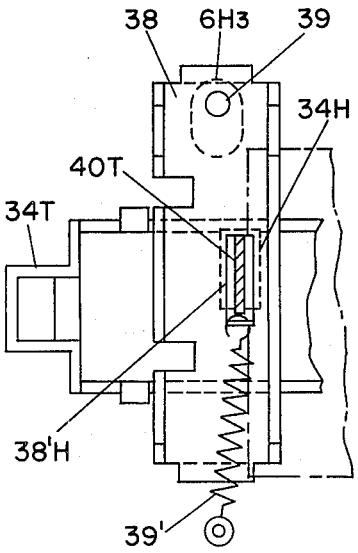
FIG. 4B is a partial view of FIG. 4A in a different condition.
Figure 4A:
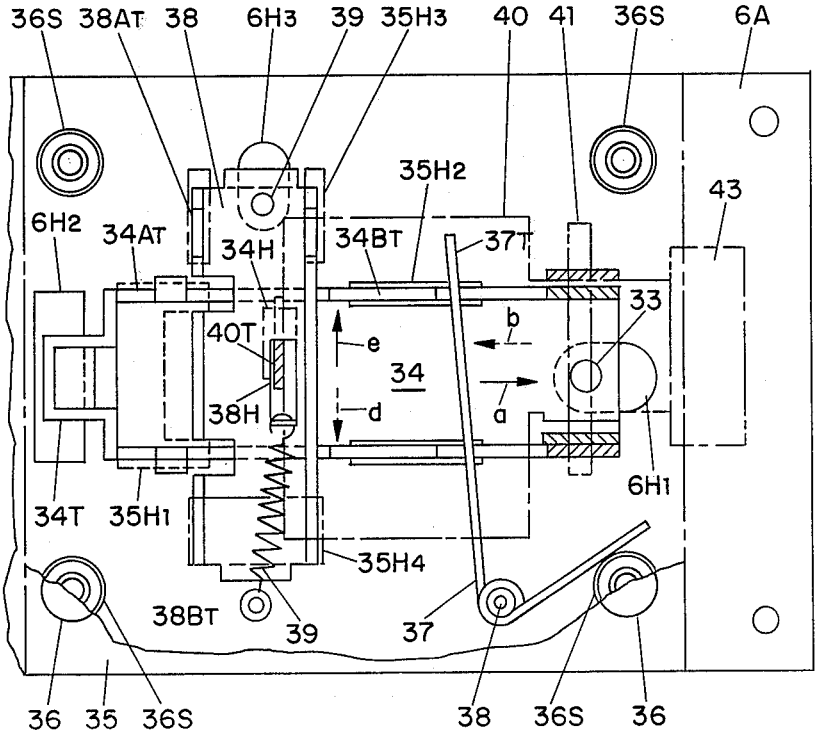
FIG. 4A is a partially cutaway view in the IV—IV direction.

The structure of the preparation mechanism for locking and unlocking 17 and the automatic retaining mechanism 31 is now described referring to FIG. 3 and FIG. 4. FIG. 3 is a longitudinal cross-sectional view of the operation unit 11 in FIG. 2. FIG. 4A is a partially cutaway view in the IV—IV direction, and FIG. 4B is a partial diagrammatic view. The lock shaft 34, formed Π-shape, is fixed to the unlocking knob 7 by the rivet 33, which slides freely in the arrow direction (a) and the return direction (b). In accordance with these motions, the rivet 33 moves freely in the guide hole 6H1. The top of the lock shaft 34T is caught by the latch 9 of the said hook 8. The latch 9 is inserted through the hole 6H2. The fixing cover 35 is fixed to the clasp 6A by the screws 36 through the struts 36S. On the cover 35, the guide holes 35H1 and 35H2 are provided to limit the motion of the lock shaft 34 in both directions (a) and (b), since the top ends 34AT and 34BT are inserted in the said guide holes 35H1 and 35H2. The scissors shaped compression spring 37 is connected to the pin 38, supported by the strut 36S on one end, and pressing the lock shaft 34 in the direction (b) at all times on the other end 37T. The rectangular hole 34H is provided on the lock shaft 34. The top of the moving piece 40T is inserted into the hole 34H when the solenoid is not in operation. FIG. 3 shows the attracting condition of the moving piece 40 by the solenoid 16. The latch shaft 38 of the automatic retaining mechanism is connected to the operation knob 10 by the rivet 39. The traverse of the latch shaft 38 in the directions (e) (d) perpendicular to the moving directions (a)(b) of the said lock shaft 34 is limited by the guide hole 6H3 provided on it. The side plate ends 38AT, 38BT of the latch shaft 38 is connected to the guide holes 35H3 35H4 of the cover 35 so as to slide.

FIG. 4A shows the condition where the latch shaft 38 is released from the restriction of the moving piece 40T to be pulled to the arrow direction (d) by the spring 39'. Accordingly, the rectangular hole 38H and the hole 34H are misaligned, thereby preventing the insertion of the moving piece 40T into these holes. The moving piece 40 is driven up and down in FIG. 3 and perpendicular to the drawing in FIG. 4 by the solenoid 16 and the spring 42, around the shaft 41, supported by the bearing in the cover 35 as the fulcrum point. As mentioned before, the drawing shows the condition where the solenoid 16 is operated by the key input of unlocking, the moving piece 40 is drawn downward, and the top end 40T of it is released from the restriction hole 34H and also from the through hole 38H of the latch shaft. After this, the key (S) is pushed to cut off the current. When the unlocking preparation is completed, sound is transmitted, and the top of the moving piece 40T is held near the hole 38H by the spring 42 and the balance weight 43, attached to the other end of the moving piece 40. In this condition, the lock shaft 34 is energized in the arrow direction (b) only by the spring 37, and the top end 34T of it is interlocked with the hook latch 9 keeping wait-for-unlocking condition. This is the function of the retaining mechanism 31, and in this condition, only the push of the unlocking knob 7, against the force of the spring 37 in the arrow direction (a), opens the suit case, releasing the top of the lock shaft 34T from the hook latch 9. At the closing of the suit case, it is performed only by the insertion of the hook latch 9 into the hole 6H2 on the clasp 6A.

Now referring to FIG. 4B, when the control knob 10 is pushed in the arrow direction (e), the latch shaft 38 moves against the spring force of the spring 39'. Therefore, the hole 38H comes to the position of 38'H, where the hole 38'H and the hole 34H are aligned. Since the width of the hole 38H is wider than that of the top of the moving piece 40T, the top end 40T goes through the hole 38'H and the hole 34H by the force of the spring 42. Thus the movement of the lock shaft 34 in the direction (a) or (b) is restricted. For unlocking this condition, the solenoid 16 must be operated by regular key input. The operation of the knob 10 in the arrow direction (e) can be made freely by the owner at any time depending on the situation.

Described above is an embodiment of the electronic locking device according to this invention applied to a suit case, and the application of this invention is not limited to suit cases, as a matter of course, but is also applicable to other doors, for example, of buildings, safes or automobiles. The mechanisms shown in FIG. 3 and FIG. 4 are only an example, therefore, it may also be composed of a small D.C. motor in place of the solenoid, and many other mechanisms are conceivable, all of which are within the scope of the present invention without being mentioned any further. Being composed as described above, this invention offers a convenient device of easy handling yet maintaining highly confidential performance because of the free selection by the user for manual opening or closing, or key input opening or closing, depending upon the circumstances.

What is claimed is:

1. An electronic locking device including an electronic control unit which operates a driving unit by a code input from outside and having a locking position and an unlocking position comprising:

(a) an unlocking member moving freely by manual operation of an unlocking knob connected to the unlocking member, wherein, when the code input is given, the unlocking member and the unlocking knob are selectively operated from outside, the unlocking member having first interlocking means for being restrained by a moving piece of the driving unit when the locking device is in the locking position and when the driving unit is in a non-operated condition;

(b) a retaining mechanism traversing freely with respect to the unlocking member and having second interlocking means for restricting the moving piece, wherein, both the first and second interlocking means are aligned when the locking device is in the locking position, and both the first and second interlocking means are misaligned when the locking device is in the unlocking position; and (c) an operation knob for releasing the restriction of the moving piece when the driving unit is in the non-operated condition.

2. An electronic locking device according to claim 1, wherein the driving unit includes a solenoid.

* * * * *